US006334674B1

(12) United States Patent
Ono et al.

(10) Patent No.: US 6,334,674 B1
(45) **Date of Patent: *Jan. 1, 2002**

(54) ABSORBER MOUNTED IN AN INK TANK AND PROCESS FOR MANUFACTURING THIS TANK

(75) Inventors: Takayuki Ono, Kawasaki; Hiroshi Sugitani, Machida; Kazuaki Masuda, Kawasaki; Hajime Yamamoto, Yokohama; Eiichiro Shimizu, Urawa; Torachika Osada, Yamato; Masahiko Higuma, Togane; Keisuke Matsuo, Yokohama; Jun Hinami, Kawasaki; Masaru Iketani, Sagamihara, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/689,012

(22) Filed: Jul. 30, 1996

(30) Foreign Application Priority Data

| | | |
|---|---|---|
| Aug. 2, 1995 | (JP) | 7-197409 |
| Nov. 2, 1995 | (JP) | 7-285958 |
| Jul. 24, 1996 | (JP) | 8-194716 |

(51) Int. Cl.[7] ..... B41J 2/175
(52) U.S. Cl. ..... 347/86
(58) Field of Search ..... 347/86, 87, 85; 29/451

(56) References Cited

U.S. PATENT DOCUMENTS

| | | | | |
|---|---|---|---|---|
| 4,729,808 A | | 3/1988 | Berger | 156/180 |
| 4,794,409 A | | 12/1988 | Cowger et al. | |
| 4,969,998 A | | 11/1990 | Allen | |
| 5,119,115 A | * | 6/1992 | Buat et al. | 347/86 |
| 5,182,581 A | * | 1/1993 | Kashimura et al. | 347/87 |
| 5,280,299 A | * | 1/1994 | Saikawa et al. | 347/87 |
| 5,319,841 A | * | 6/1994 | Yata et al. | 29/451 |
| 5,453,771 A | * | 9/1995 | Waseda et al. | 347/86 |
| 5,567,373 A | | 10/1996 | Sato et al. | 264/112 |
| 5,652,610 A | | 7/1997 | Kawai et al. | 347/87 |
| 5,815,184 A | | 9/1998 | Ujita et al. | 347/89 |

FOREIGN PATENT DOCUMENTS

| | | |
|---|---|---|
| EP | 0 624 475 | 11/1994 |
| EP | 0691207 | 1/1996 |
| JP | 56126189 | 10/1981 |
| JP | 57207067 | 12/1982 |
| JP | 61012352 | 1/1986 |
| JP | 04034058 | 2/1992 |
| JP | 04281055 | 10/1992 |
| JP | 05071058 | 3/1993 |
| JP | 0 562 733 | 9/1993 |
| JP | 06033356 | 2/1994 |
| JP | 06079882 | 3/1994 |
| JP | 7-47688 | 2/1995 |
| JP | 07323566 | 12/1995 |

OTHER PUBLICATIONS

Webster's II New Riverside Dictionary; p. 394, 1984.*

* cited by examiner

*Primary Examiner*—Judy Nguyen
(74) *Attorney, Agent, or Firm*—Fitzpatrick, Cella, Harper & Scinto

(57) ABSTRACT

An ink absorber is housed inside a housing of an ink tank and is capable of retaining ink. The ink absorber has an outer surface equal to or corresponding to a shape of an internal surface of the housing and is made of a fiber material obtained by compressing a fiber body and thermally molding at least a surface thereof. An ink tank is comprised of the ink absorber and the housing. An ink jet cartridge is comprised of the ink tank and a print head. The ink absorber has an outer surface equal to or corresponding to a shape of an internal surface of the housing before being inserted into the housing. The ink absorber comprises a fiber material, and is formed by compressing a fiber body and thermally molding at least a surface thereof.

14 Claims, 13 Drawing Sheets

ABSORBER MOUNTED IN AN INK TANK AND PROCESS FOR MANUFACTURING THIS TANK

BACKGROUND OF THE INVENTION

1. Field of the Invention

The present invention relates to an ink absorber used in ink jet recording apparatus for performing recording as ejecting ink, an ink tank and an ink jet cartridge using the ink absorber, a process for producing the ink tank, a fiber body used in the ink tank, and an ink jet recording apparatus capable of mounting the ink jet cartridge. More specifically, the invention concerns the field of ink jet recording as applying a fiber material to the ink absorber.

2. Related Background Art

It is conventionally general to provide the ink tank used in ink jet recording with a mechanism for adjusting the pressure of ink stored in the ink tank from the viewpoint of maintaining a good ink supply property to the ink jet recording head, and the like. Since this pressure is for making the pressure at an ejection outlet negative relative to the atmospheric pressure, it is called as a negative pressure.

One of the easiest methods for generating the negative pressure is a method for setting an ink absorber in the ink tank to utilize the capillarity of the absorber. Particularly, a foam such as urethane sponge or the like is used as an ink absorber from the standpoint that it is easy to fabricate a porous structure with uniform porosity excellent in capability of retaining the ink.

The foam of urethane sponge or the like needs a film removing process before use as an ink absorber, because in a state of the foam just after fabricated, foam cells each exist in an isolated state from each other by films. Some types of ink used had a possibility of appearance of an eluate because of chemical stability of the foam itself, which sometimes imposed a restriction on the ink used.

In order to solve the above problem, recently proposed are a method for making the ink absorber of a fiber bundle as described in Japanese Laid-open Patent Application No. 6-79882 and a method for making the ink absorber of a felt being a fiber material as described in Japanese Laid-open Patent Application No. 7-323566.

However, the many ink tanks using the conventional fiber bundle as described above include a small number of fibers linearly existing or a bundle of fibers packed in one direction, and thus have little capability of retaining the ink. Therefore, there is a possibility of contraction of fibers in a bundle form due to charge of ink.

On the other hand, the following technological subjects were found out as to the ink tanks using the felt as described above. Namely, when the conventional felt was used as an absorber, it was very difficult to make a single layer of a low-density felt capable of generating a desired negative pressure as an ink absorber with an increase of the size of ink tank.

It is thus usually necessary to use a laminate of felts. However, since a felt laminate is easy to deform, when blanked, in the blanking direction, advanced techniques are required to raise the blanking accuracy of felt. Since the strength of the felt laminate is lower in the laminate direction than in the directions perpendicular to the laminate direction, there is a possibility that the felt is broken when an ink supply tube is put into the laminate surface and air reserved in that portion could impede supply of ink. Thus there is a limitation on the position of the ink supply tube.

There was a further possibility of runout in ink or the like at interfaces of the laminate.

Configurations of the recent ink tanks tend to become more and more complicated in order to effectively utilize the limited space in the ink jet recording apparatus. In addition, the tanks are often provided with a mechanism for preventing erroneous mounting with spread of multi-color arrangement of ink used, which accelerates the complexity tendency of configuration more. In manufacturing the ink absorbers used in the ink tanks of such complicated configurations, there was the problem that manufacturing steps became complex for blanking in predetermined shapes, as described above.

Namely, blanking is done in one direction for the felt laminate up to a predetermined thickness, and thus, the configurations of the ink absorbers obtained in this manner are limited to those as shown in FIGS. 14A and 14B.

For example, for obtaining the configuration shown in FIG. 14C, a process in the direction shown by arrow b is necessary in addition to a process in the direction shown by arrow a, but such processes are not carried out by blanking, but often by hand. Such hand works would raise problems of increasing the manufacturing cost, lacking in stability of configuration, and so on. These problems will arise not only in the cases using the felt, but also in the method using the foam. The problems are significant especially in the cases where the ink tank is shaped further including an inclination portion or recessed and projected portions. On the other hand, in the case of the method using the conventional fiber bundle as described above, it was also difficult to insert the fiber bundle into a complex shape and a solution thereto has been desired long.

SUMMARY OF THE INVENTION

The present invention has been accomplished in view of the above problems, and an object of the invention is to use fibers as an ink absorber and thus to provide an ink absorber suitably fit to a complex configuration of ink tank, an ink tank using the ink absorber, a process for producing the ink tank, and an ink jet cartridge integrally incorporating the ink tank and an ink jet recording head.

A specific means for achieving the above object is an ink absorber housed in a housing of an ink tank and being capable of retaining ink, the ink absorber having an outer surface equal to or corresponding to a configuration of an inner surface of the housing and comprising a fiber material obtained by compressing a fiber body and thermally molding at least a surface thereof. This can solve the above various problems in the cases using the foam for the ink absorber and can provide the ink absorber fit well to a complex configuration of ink tank, which has been the technical subject in the ink absorbers utilizing the conventional felt.

Another aspect of the invention is an ink tank comprising an ink absorber capable of retaining ink and a housing for housing the ink absorber and having an air-communicating portion, wherein the ink absorber has an outer surface equal to or corresponding to a configuration of an inner surface of the housing and comprises a fiber material obtained by compression and thermal molding of at least a surface. This can provide the ink tank of a complex shape effective to utilize the limited space in the ink jet recording apparatus.

Another aspect of the invention is a process for producing an ink tank having an ink absorber capable of retaining ink and a housing for housing the ink absorber, comprising a first molding step of molding a continuous fiber aggregate of a rod shape or a plate shape with elasticity, a step of cutting the fiber aggregate thus molded to form a fiber body, a second molding step of compressing and thermally molding the fiber body to shape an outer surface thereof corresponding to a configuration of the inside of the housing, thereby forming an ink absorber, and a step of inserting the ink absorber into the inside of the housing. By this, the ink tank of the complex shape as discussed previously can be produced easily and cheaply.

A further aspect of the invention is a fiber body being an aggregate of many short fibers, used as a raw material for an ink absorber of an ink tank used in the ink jet recording apparatus, which has elasticity and which is obtained by cutting a continuous short-fiber aggregate of a rod shape or a plate shape a surface layer of which is thermally bonded, whereby in fabrication of the ink absorber having the outer surface corresponding to the configuration of the inner surface of the housing of the ink tank in the above fabrication steps, an intermediate product with good operability in fabrication apparatus can be provided.

DESCRIPTION OF THE PREFERRED EMBODIMENTS

The embodiments of the present invention will be described in detail with reference to the drawings.

(First Embodiment)

Figure 1:
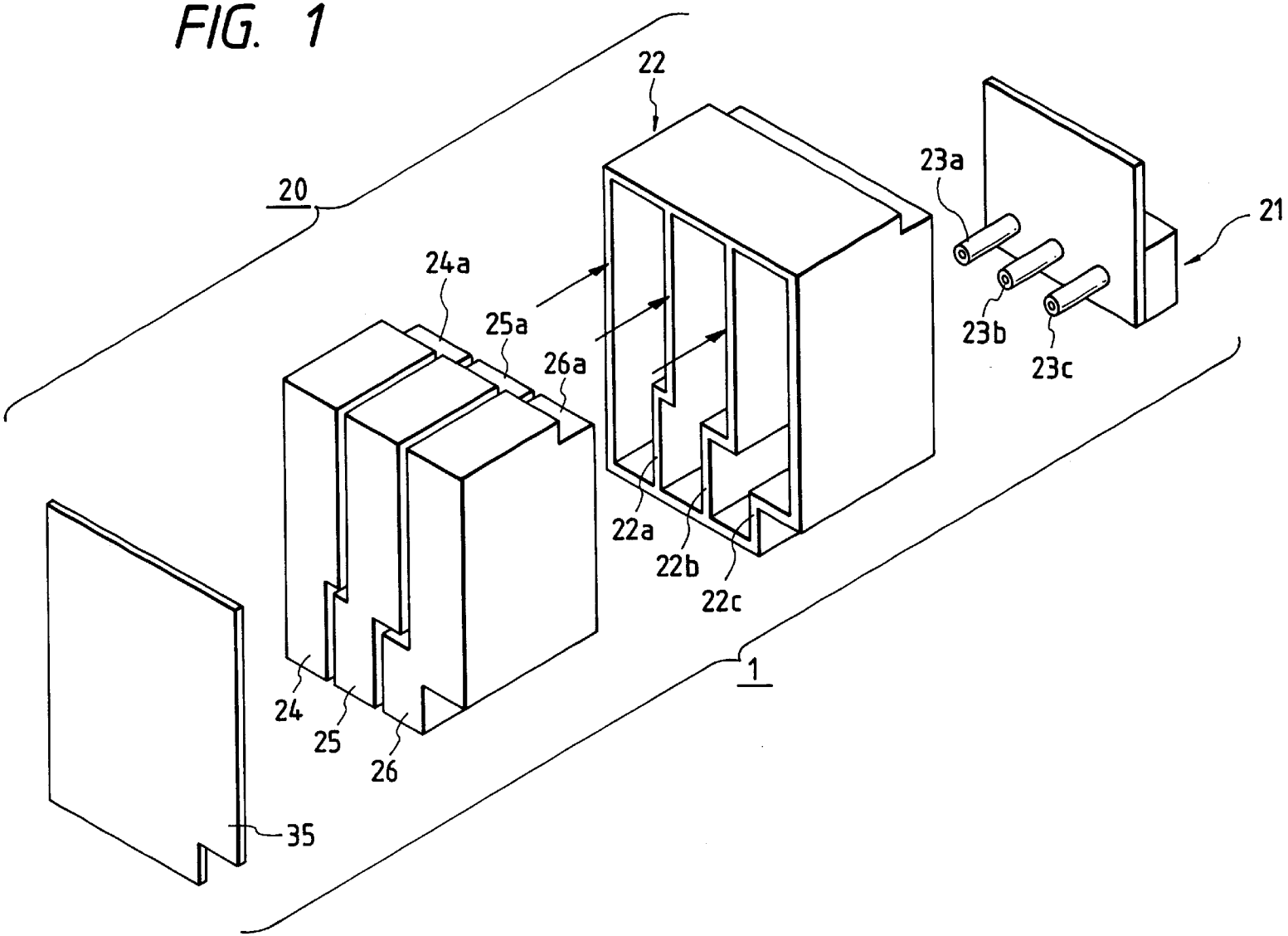
FIG. 1 is an exploded perspective view of an ink jet cartridged according to an embodiment of the present invention.

FIG. 1 is an exploded perspective view to schematically show an ink jet cartridge provided with an ink tank to which the present invention can be applied.

An ink jet cartridge 1 is composed of an ink jet head 21 for ejecting ink of yellow (Y), magenta (M), or cyan (C), and an ink tank 20 detachably mountable to the ink jet head. The ink jet head 21 is connected to the ink tank 20 through ink supply tubes 23*a*, 23*b*, 23*c* corresponding to the respective colors, and each ink is supplied to the ink jet head through an ink supply tube corresponding thereto. The ink tank 20 is arranged in such a manner that an inner space of a recessed container 22 forming a housing together with a lid member 35 is partitioned into three chambers by two bulkhead members 22*a* and 22*b* and that ink absorbers 24, 25, and 26 are housed inside the respective chambers to retain the Y, M, and C ink. Each chamber has an air-communicating portion not shown, through which the inside of the housing is in communication with the atmospheric air.

The outer configuration of the ink tank 20 has a recessed portion 22*c* at a part of the housing in order to avoid interference with the inside of an apparatus when mounted to the apparatus. From the standpoint of amounts of containing ink or the like, the above three chambers all are shaped according to the recessed portion, and parts of the bulkhead members 22*a* and 22*b* are shaped to have bending portions.

Each of the ink absorbers 24, 25, 26 housed in the regions (hereinafter referred to as the inside of the housing or as ink absorber receiving portions) surrounded by the housing and bulkhead members of the ink tank 20 has an outer surface equal to or corresponding to an irregular shape of an internal surface (hereinafter referred to as a housing internal surface) of each ink absorber receiving portion and is made of a fiber material obtained by compressing fibers containing polypropylene fibers and polyethylene fibers mixed at the weight ratio of 7:3 into the shape of each chamber in the ink tank and thermally molding the surface thereof.

Next, a process for producing the ink tank of the present invention is explained in detail referring to FIG. 2 and FIGS. 3A to 3C.

Figure 2:
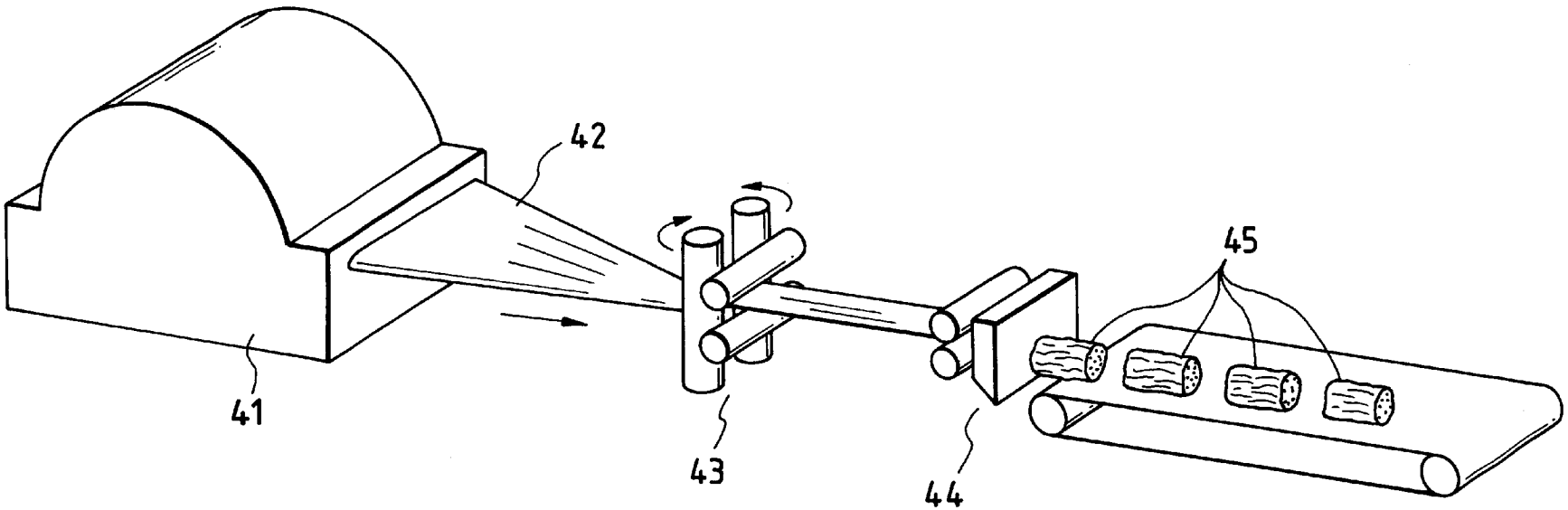
FIG. 2 is a schematic drawing to show a production apparatus for producing fiber bodies of the present invention.
Figure 3A:
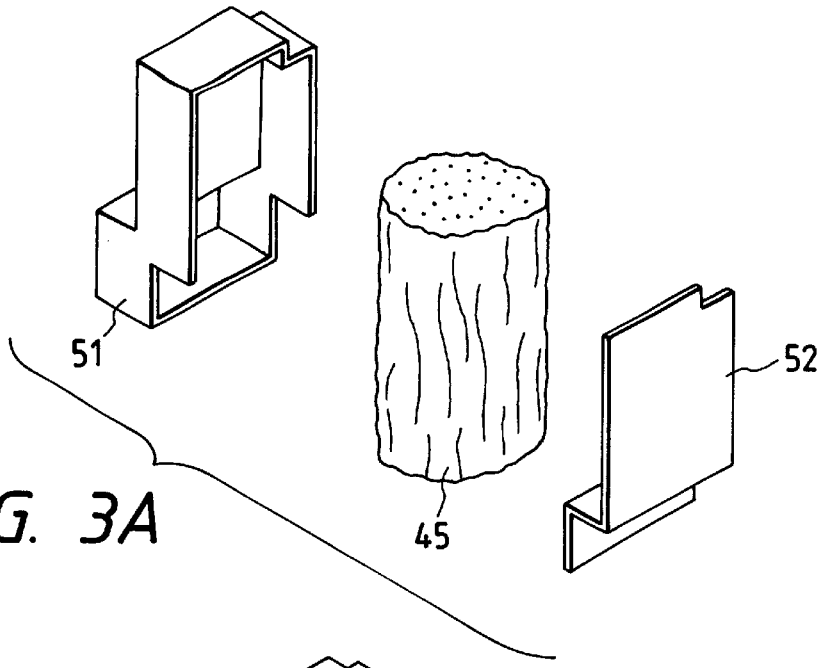
FIGS. 3A, 3B, and 3C are schematic explanatory drawings to show a process for molding an ink absorber of the present invention.
Figure 3B:
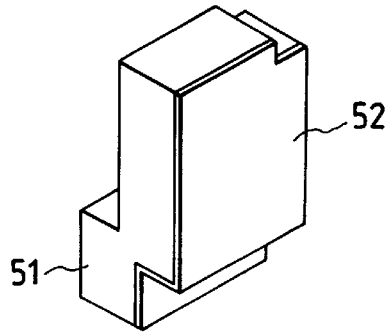
Figure 3C:
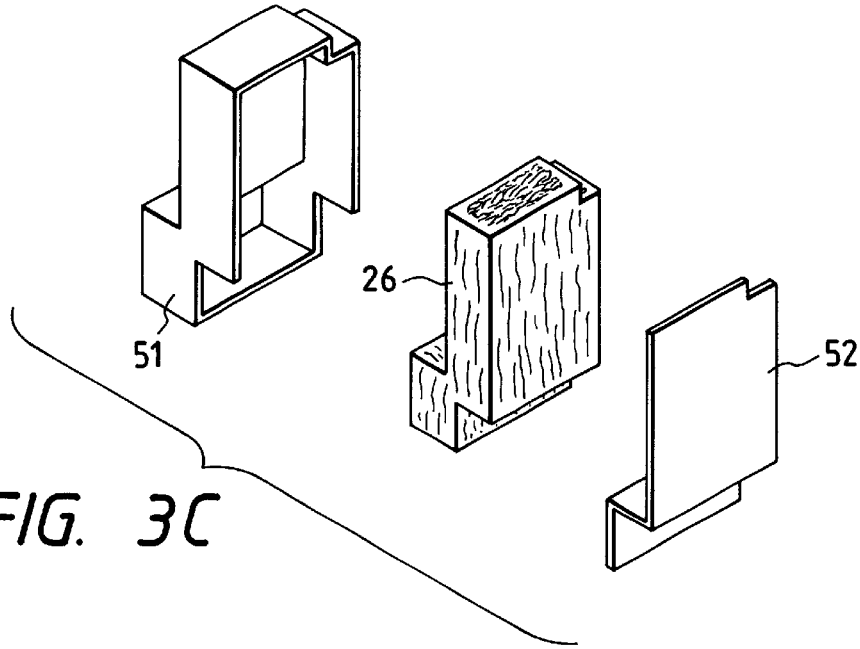

FIG. 2 is a schematic drawing to show a production apparatus for producing the fiber body used for the ink tank of the present invention, and FIGS. 3A to 3C are schematic explanatory drawings to show a method for molding the ink absorber for the ink tank of the present invention.

First molding is a continuous fiber aggregate of a rod shape or a plate shape having elasticity (first molding step). In the present embodiment, the fibers of polypropylene fibers and polyethylene fibers mixed at the weight ratio of 7:3 are guided through a carding machine 41 shown in FIG. 2, so that the tangling fibers are disentangled to be processed into a sheet web 42 in which the fibers are aligned nearly in parallel and which has stable fiber density. Then this web 42 is bundled and guided through heating rollers 43 to subject the surface layer to thermal adhesion, thereby molding the continuous fiber aggregate. Since the continuous fiber aggregate in the present embodiment is formed using the carding machine, it is an aggregate of short fibers, of course.

The temperature of the heating rollers 43 may be determined in the range higher than the melting point of the polyethylene fibers and lower than the melting point of the polypropylene fibers. The longer the contact time between the fibers and the heating rollers, the lower the temperature is preferably set; the shorter the contact time, the higher the temperature. For example, supposing the polyethylene fibers have the melting point of 132° C., the temperature of the heating rollers is desirably set in the range of 135° C. to 155° C. Any heating means can be applied as long as it can effect the thermal adhesion of only the surface layer; for example, hot air may be sent to blow the surface layer. In the case of the hot air being used, the temperature should better be set higher than in the case of the heating rollers being used.

When the carding machine is used, short fiber masses (staple fibers) are normally used as a raw material, and they are supplied through a splitting step to the carding machine. When a continuous long-fiber bundle (tow) is used as a raw material, the tow is cut into pieces and then the cut tow pieces are blown, thus effecting splitting. This is more desirable because the splitting step can be omitted.

Next, the continuous fiber aggregate is cut in standard units by a cutter 44 to form fiber bodies 45 (second molding step). The cutting length is determined to be nearly equal to or slightly larger than either one side of a mold for the ink absorber. In compressing the fiber body, it can be compressed easier in the directions nearly perpendicular to the fiber direction than in the fiber direction, and therefore, the fiber body can be compressed better also into a complex configuration when the length of the fiber body is determined as described above.

The fiber body 45 with only the surface layer subjected to thermal adhesion is as if a nonwoven fabric covers cotton fibers almost aligned in a direction. Since this surface layer portion has such strength as to facilitate handling in automated steps, including conveyance, the production steps of the ink absorber as described below become very easy. The ink absorber is next molded using the fiber body explained above. First, as shown in FIG. 3A, the fiber body 45 having the almost same length as one side of mold 51 is inserted into the mold 51 formed in the size nearly equal to or slightly larger than the size of the ink absorber receiving chamber of the ink tank. One or more fiber bodies 45 may be used depending upon the volume of the ink tank.

Since the fiber body 45 is as if a nonwoven fabric wraps a fiber aggregate of fibers aligned in a direction, as described above, it can readily get to fit to the shape of the mold.

Next, as shown in FIG. 3B, a lid 52 is set after the fiber body 45 is housed in the mold 51. This lid 52 keeps the fiber body 45 in a constant compression state.

Then the mold with the fiber body is heated in the state shown in FIG. 3B in a heating furnace, whereby the fiber body 45 is thermally molded into the configuration of the mold to become an ink absorber 26.

The temperature of the heating furnace may be determined at any degrees within the range higher than the melting point of the polyethylene fibers and lower than the melting point of the polypropylene fibers. For example, when the melting point of the polyethylene fibers was 132° C., the temperature of the heating furnace applicable was between 135° C. and 155° C. A period of heating time can be adjusted depending upon the strength required.

Application of heat fuses the polyethylene fibers, so that the polyethylene fibers fused play a role of an adhesive to secure intersecting points of the polypropylene fibers three-dimensionally entangled so as to increase the strength. Therefore, if the strength is required, heating had better be continued for a relatively long period of time until heat is transferred perfectly into the inside, though it depends upon the configuration of the ink absorber. If flexibility is required, heating should be continued for a relatively short period of time so that the heat is not completely transferred into the inside.

For solidifying the fiber body up to the inside, the fiber body is first heated outside the mold, and then it is put into the mold before the temperature of the polyethylene fibers becomes below the melting point, so as to be compression-molded, which can decrease the molding time.

Also, the strength can be adjusted by changing a mixture ratio of the polyethylene fibers and the polypropylene fibers. If the strength is required, an amount of the polyethylene fibers is increased in the fiber body; if flexibility is required, an amount of the polyethylene fibers is decreased in the fiber body.

Then the ink absorber 26 is taken out of the mold, as shown in FIG. 3C. The ink absorber at this time has a shape corresponding to the irregular shape of the inner surface of the housing, but the size thereof is a little larger than that of the ink absorber receiving portion.

The ink absorbers produced in this manner are inserted through opening portions into the ink tank 20 preliminarily equipped with ink supply ports as shown in FIG. 1 and then the opening portions are closed by the lid member 35, thus obtaining an ink tank.

Since the size of the ink absorber before inserted is a little larger than the size of the ink absorber receiving portion, as described above, the ink absorber can be inserted thereinto without forming a clearance between the internal wall of the ink tank and the ink absorber. Since the all surfaces of the ink absorber are thermally molded, an ink supply port can be formed in an arbitrary surface, different from the case of the ink absorber using the conventional felt.

As explained above, since the production steps of the ink tank include the separate steps of forming the fiber body and thermally molding the fiber body in the mold, the process is easily ready for forming ink absorbers of various shapes by using different molds.

(Second Embodiment)

Figure 4:
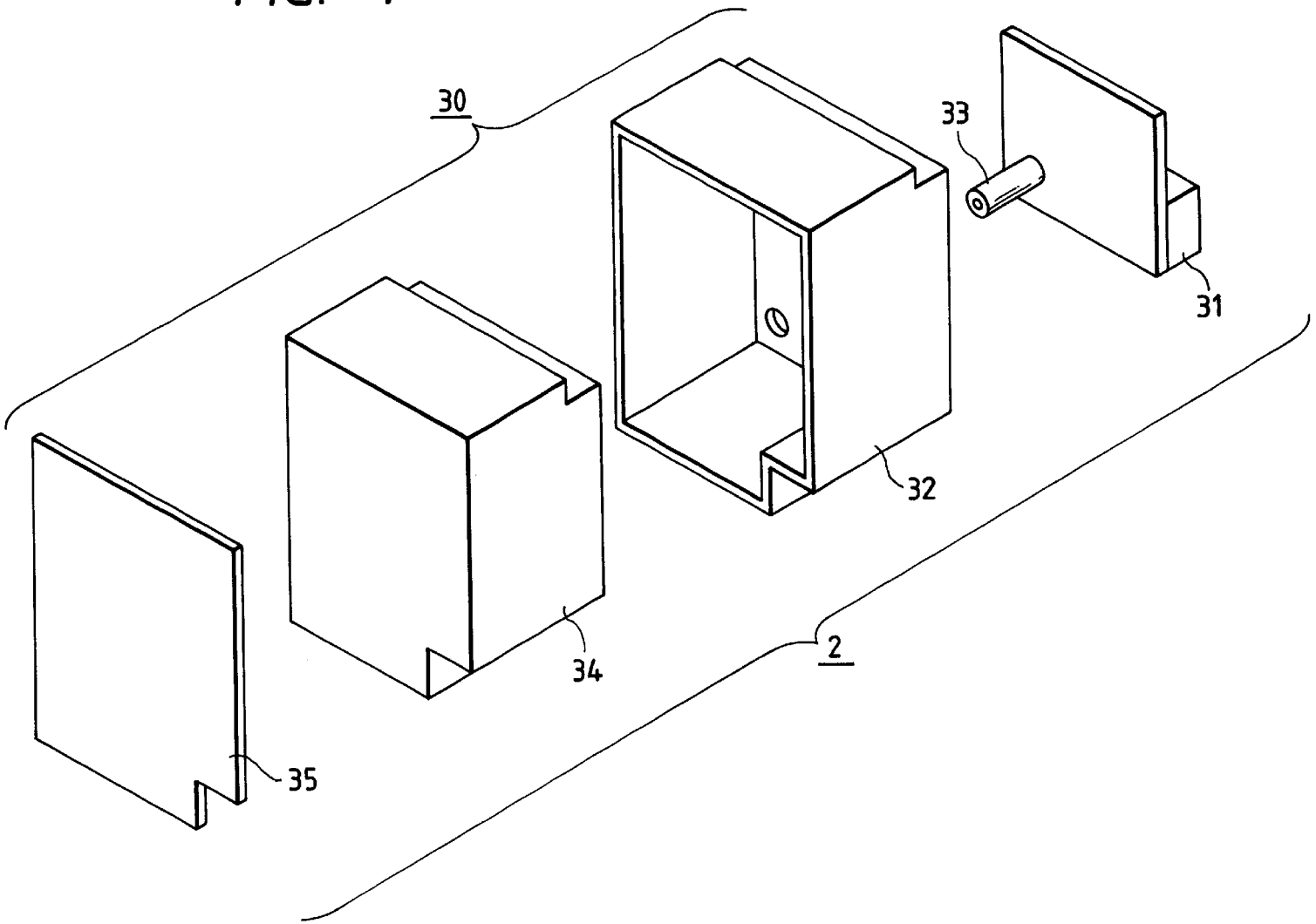
FIG. 4 is an exploded perspective view of an ink jet cartridge according to another embodiment of the present invention.
Figure 5:
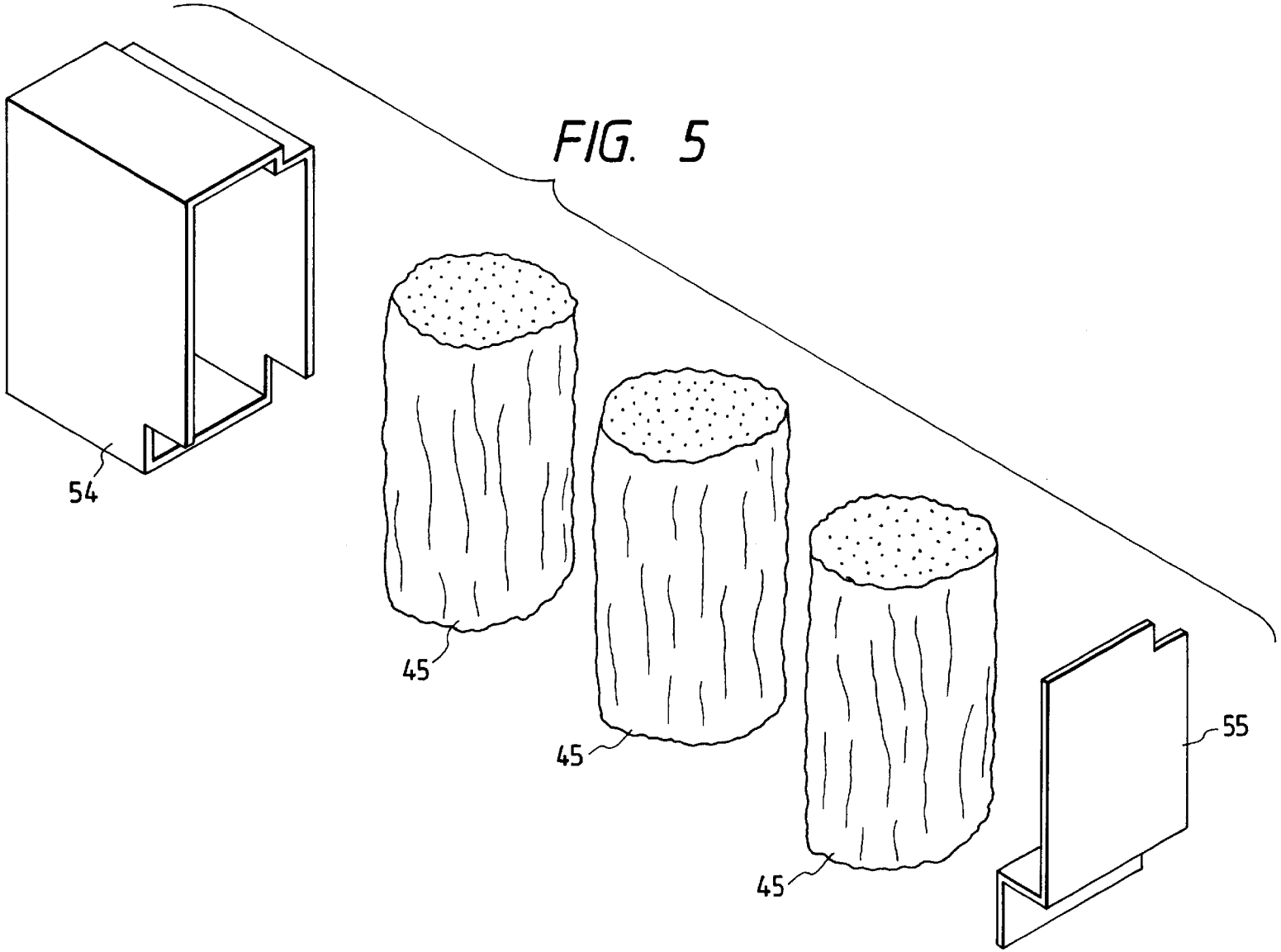
FIG. 5 is a schematic explanatory drawing to show a process for molding an ink absorber according to another embodiment of the present invention.

The second embodiment of the ink tank to which the present invention can be applied is shown in FIG. 4 and FIG. 5. FIG. 4 is an exploded perspective view to show an ink jet cartridge of the second embodiment according to the present invention and FIG. 5 is an explanatory drawing to show a production step of the ink absorber used in the ink tank of the second embodiment according to the present invention.

The ink tank 30 of the present embodiment is composed of a recessed container 32, an ink absorber 34, and a lid member 35, similarly as in the first embodiment, and is detachably connected through an ink supply tube 33 to the ink jet head 31, thus composing an ink jet cartridge 2. The present embodiment is different from the first embodiment in the configuration of the ink tank 30 and in that the ink absorber is formed of a plurality of fiber bodies in the production process of the ink absorber 34 using a mold 54 and a lid 55. The ink tank 30 of the present embodiment has the ink absorber receiving portion the volume of which is larger than the volume of the ink absorber receiving portion in the first embodiment described above, and thus, the ink absorber is formed not of a single fiber body 45, but of three fiber bodies 45 of a same shape, as shown in FIG. 5.

There is no specific restriction on a method for inserting the plural fiber bodies into the mold. If the shape of the mold is relatively simple, the plural fiber bodies had better be inserted at a same time after stacked. If the shape of the mold is relatively complex, they had better be inserted one by one, because they can get to fit well to the internal shape of the mold and dispersion in the density becomes smaller.

Figure 6:
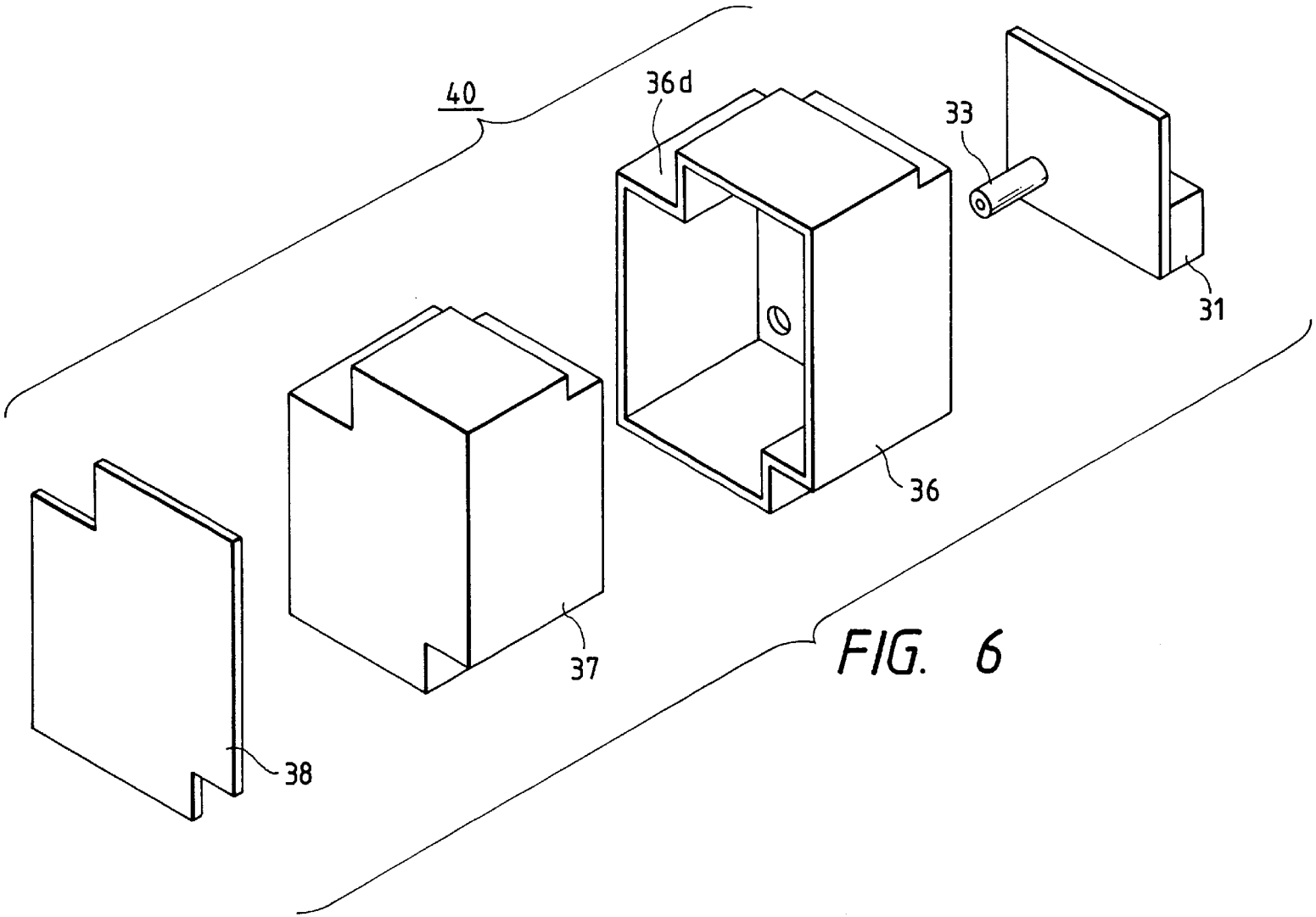
FIG. 6 is an exploded perspective view of an ink jet cartridge according to another embodiment of the present invention.
Figure 7:
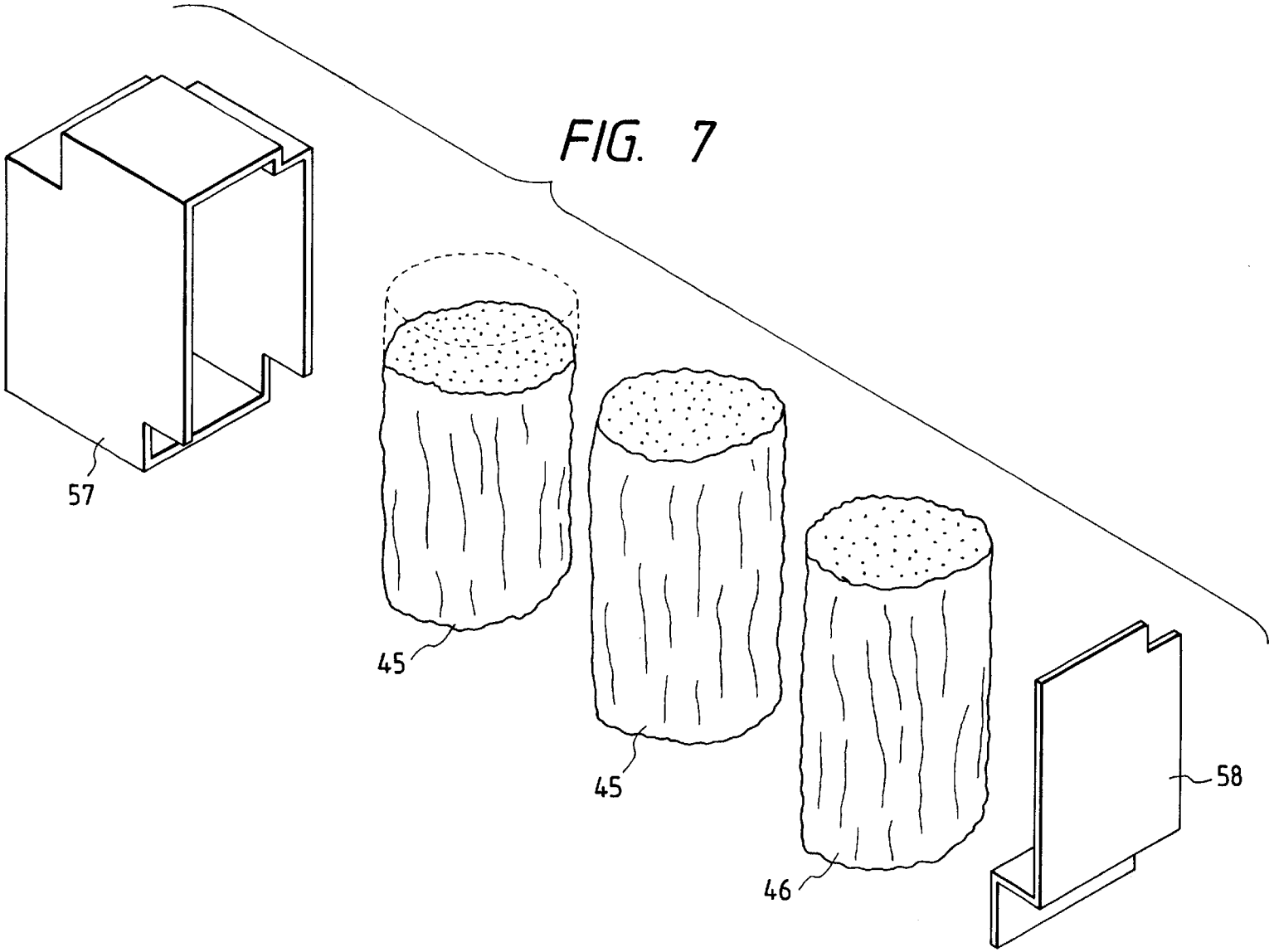
FIG. 7 is a schematic explanatory drawing to show a process for molding an ink absorber according to the present invention.

FIG. 6 and FIG. 7 show a modification of the second embodiment according to the present invention. FIG. 6 is an exploded perspective view to show the ink tank in the modification of the second embodiment of the present invention and FIG. 7 is an explanatory drawing to show a production step of the ink absorber.

This modification is provided with a cut-out portion 36*d* in the recessed container 36 and lid member 38 for preventing erroneous mounting, and thus, the shape of the ink tank 40 is further more complex than the shape of the second embodiment. Therefore, the ink absorber 36 is produced using a method for inserting fiber bodies 45 and 46 of different sizes into the mold 57, as shown in FIG. 7. Numeral 58 designates a lid corresponding to the mold 57.

Figure 14A:
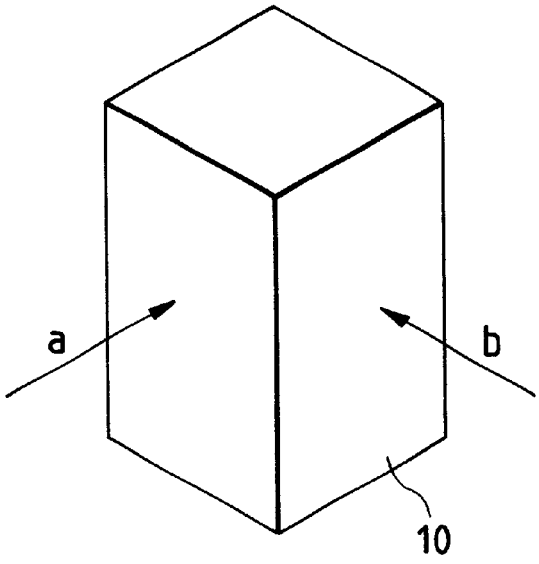
FIGS. 14A, 14B, and 14C are explanatory drawings for explaining processing for molding conventional ink absorbers.
Figure 14B:
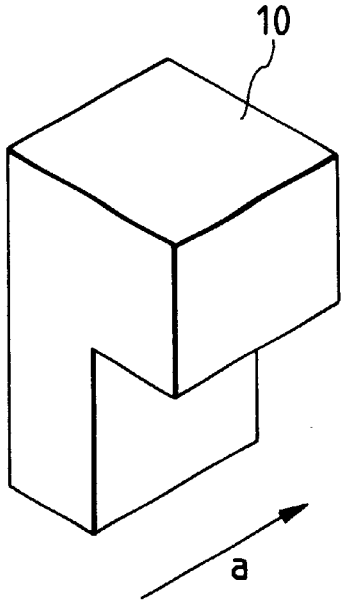
Figure 14C:
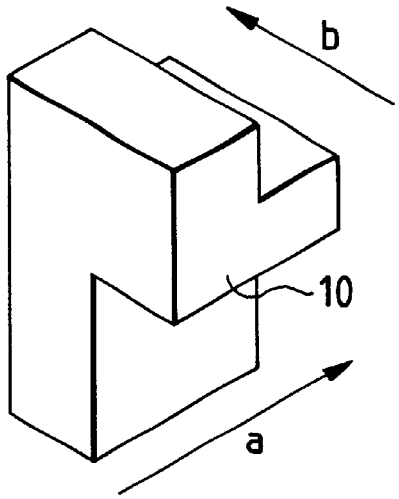

Assuming that the ink absorber that can be set in the ink tank of the shape shown in FIG. 6 were formed by the conventional process, the conventional process would require a lot of blanking steps in order to fit the fiber body to the shape, as shown in FIGS. 14A to 14C described previously. In contrast with it, application of the present invention permits the ink absorber of such a shape to be readily obtained by compression and thermal molding.

(Third Embodiment)

Figure 8:
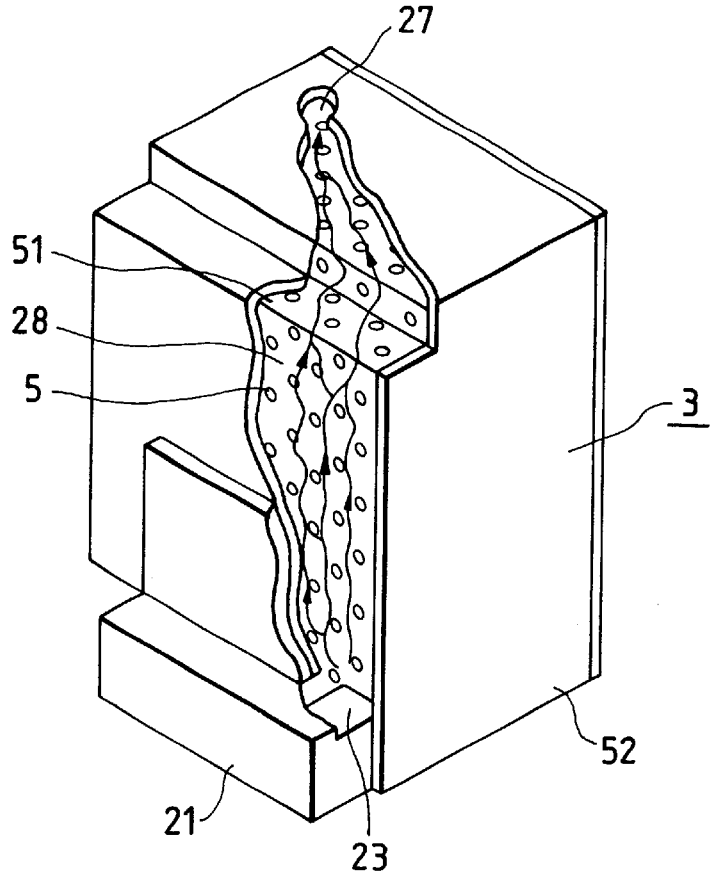
FIG. 8 is an exploded perspective view of an ink jet cartridge according to another embodiment of the present invention.

FIG. 8 is a schematic drawing of the ink jet cartridge 3 to show the third embodiment of the present invention. The ink absorber 28 in the present embodiment is made of a fiber material comprised of a fiber aggregate obtained by compressing a fiber body and thermally molding at least the surface thereof, similarly as in the other embodiments. In the present embodiment, a plurality of protrusions 5 are formed on the surface of the absorber by differentiating some parts of the shape of the mold in the production step from the internal surface of the housing 52, different from the other embodiments.

Figure 9A:
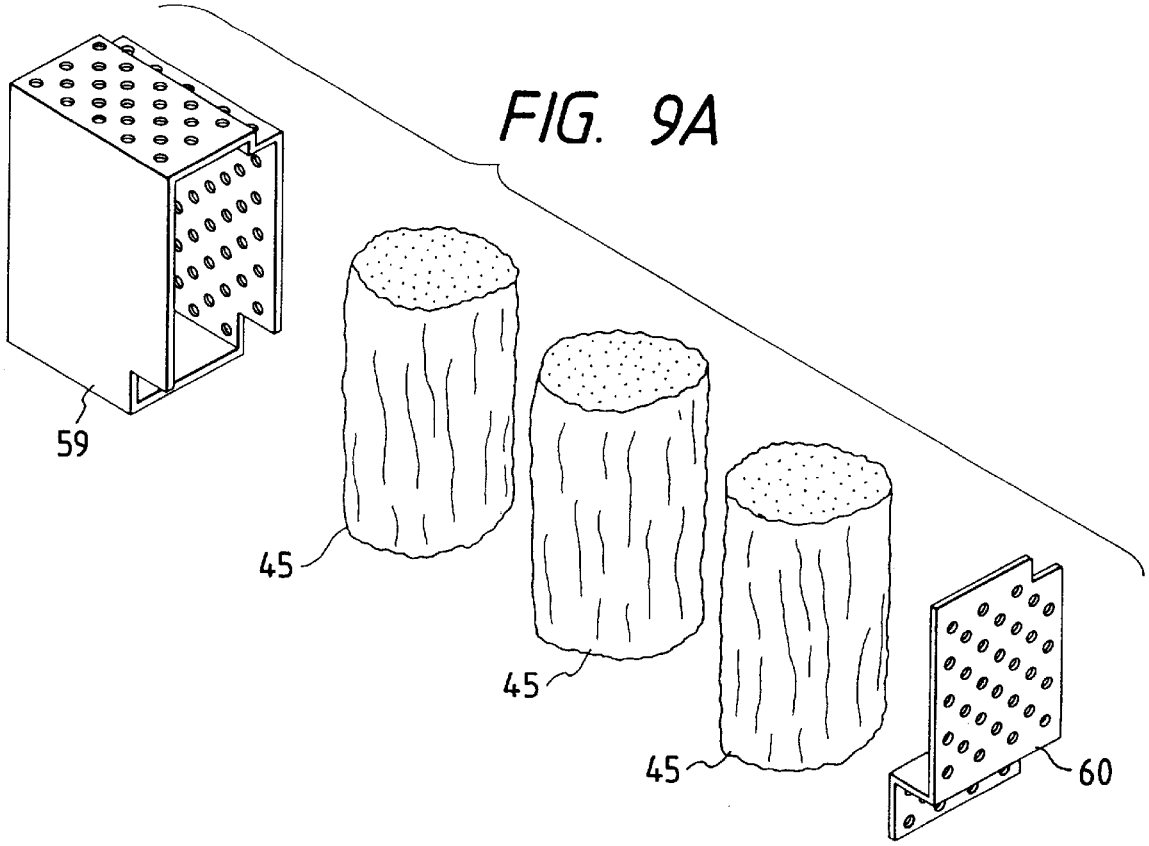
FIGS. 9A and 9B are schematic explanatory drawings to show a process for molding an ink absorber according to the present invention.
Figure 9B:
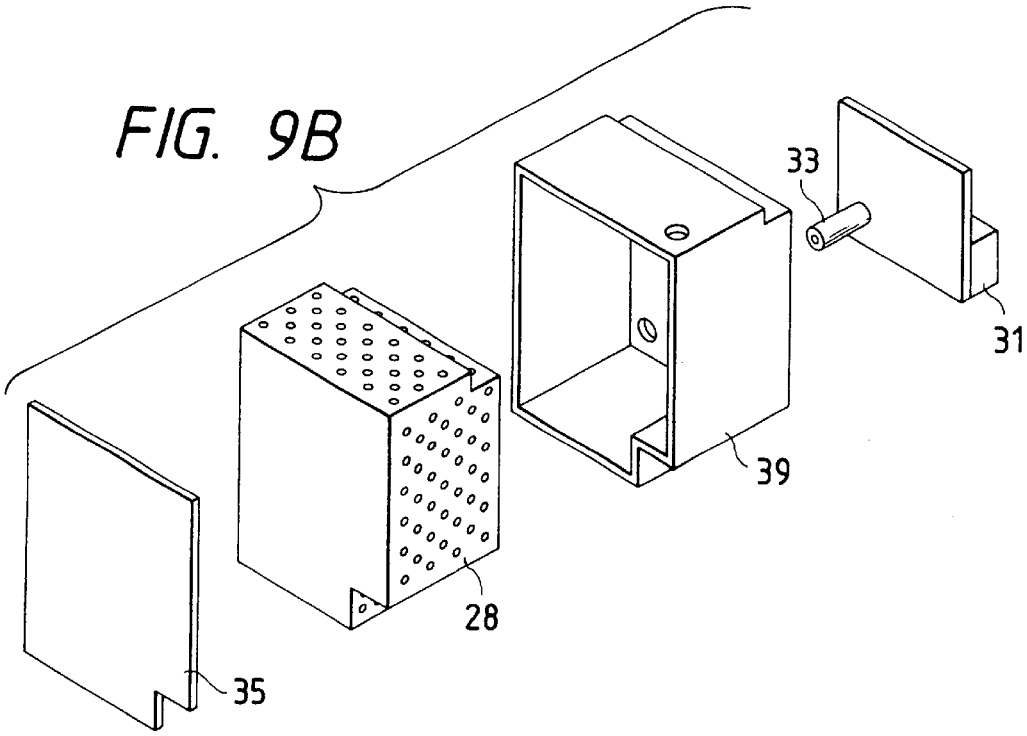

The present embodiment uses mold 59 and lid 60 (hereinafter simply referred to as a mold together) as shown in FIGS. 9A and 9B. The root of each protrusion is shaped nearly in the same diameter of a hole formed in the mold and the protrusions are arranged in the same arrangement of the holes formed in the mold.

Figure 10A:
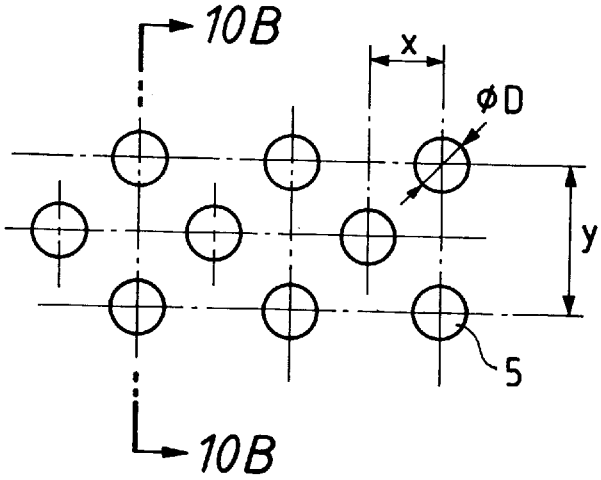
FIGS. 10A and 10B are schematic drawings to show a surface of a ink absorber according to another embodiment of the present invention.
Figure 10B:
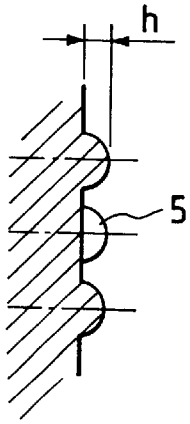

FIG. 10A shows a partly enlarged view of the surface having the protrusions of the ink absorber in the present embodiment, and FIG. 10B is a sectional view thereof along 10B—10B in FIG. 10A. In the present embodiment the mold is perforated so that the protrusions are arranged in a zigzag pattern in the diameter D of about 3 mm, the distance between the centers of protrusions being 4 mm in the x direction and 7 mm in the y direction.

Since the ink absorber 28 in the present embodiment is so arranged that the top portions of the protrusions 5 described above are in contact with the inner surface of the tank housing 52 to form a space 51 between the portions lower than the protrusions and the internal surface of housing, this space can communicate with the atmospheric air through the air-communicating portion 27.

When the absorber is inserted into the tank in each embodiment as described above, the corners of the ink absorber can readily get to fit to the corners of the internal surface of housing, when compared to the conventional method. If the absorber should fail to fit to the corners of the internal surface of housing to result in forming a blocked space, the air in the above blocked space would expand with a change of the pressure or an increase of the temperature around the ink tank, and in the worst case, the ink in the absorber could be pushed out through the ink supply port or the air-communicating portion by the air.

However, adopting the structure of the present embodiment, the air in the blocked space can communicate with the atmospheric air through the space formed between the internal surface of housing and the ink absorber by the protrusions of ink absorber, as shown by arrows in FIG. 8, and through the air-communicating portion. Therefore, the reliability against leakage of ink can be improved even with an environmental change of the pressure or the temperature.

Ribs may be formed on the internal surface of housing of the ink tank instead of the structure of the present embodiment. In this case, however, because in injection-molding the housing there is a possibility that a molded product bites the mold upon release of mold, draft is necessary, which makes it not easy to obtain a desired shape and which is a factor to drop productivity.

In contrast with it, the present embodiment can realize the structure having the same effect as the ribs inside the housing more easily by the method of higher productivity.

Further, the structure of the present embodiment can also be applied to the ink absorbers using the foam of urethane sponge or the like, but such application needs cutting techniques such as slicing, blanking, or the like or a method of thermal press or the like to process the protrusion shape. The structure of the present embodiment, by using the fiber material, has the advantage that processing of the protrusion shape according to the present invention can be realized by a smaller number of steps and at lower cost than in the case of the foam being used.

The protrusion shape of the ink absorber of the present invention may be provided on any surface as long as it is effective to make communication between the space formed in the clearance relative to the internal surface of housing with the air-communicating portion. Further, the height of the protrusion shape can be determined in the range to allow communication with the air-communicating portion. Since the ink absorber has the external surface matching with the total irregular configuration of the internal surface of housing, the protrusion shape of the present embodiment does not degrade the effect of the present invention to facilitate the setting operation into the ink tank housing.

(Other Embodiments)

The foregoing explained the embodiments of the major part of the present invention including the ink absorber and ink tank of the present invention, and the process for producing the ink tank and so on, and further embodiments applicable to the above embodiments will be explained referring to the drawings.

<Shape of Fiber Body>

The fiber body used for the ink absorber in the ink tank of the present invention is one obtained by subjecting the surface layer to thermal adhesion. Thus, the fiber body is of a rod shape. However, the shape of the fiber body is not limited to this, and to the contrary, the fiber body can be of any shape as long as it can facilitate conveyance and automation in the production steps of the ink absorber.

Figure 11:
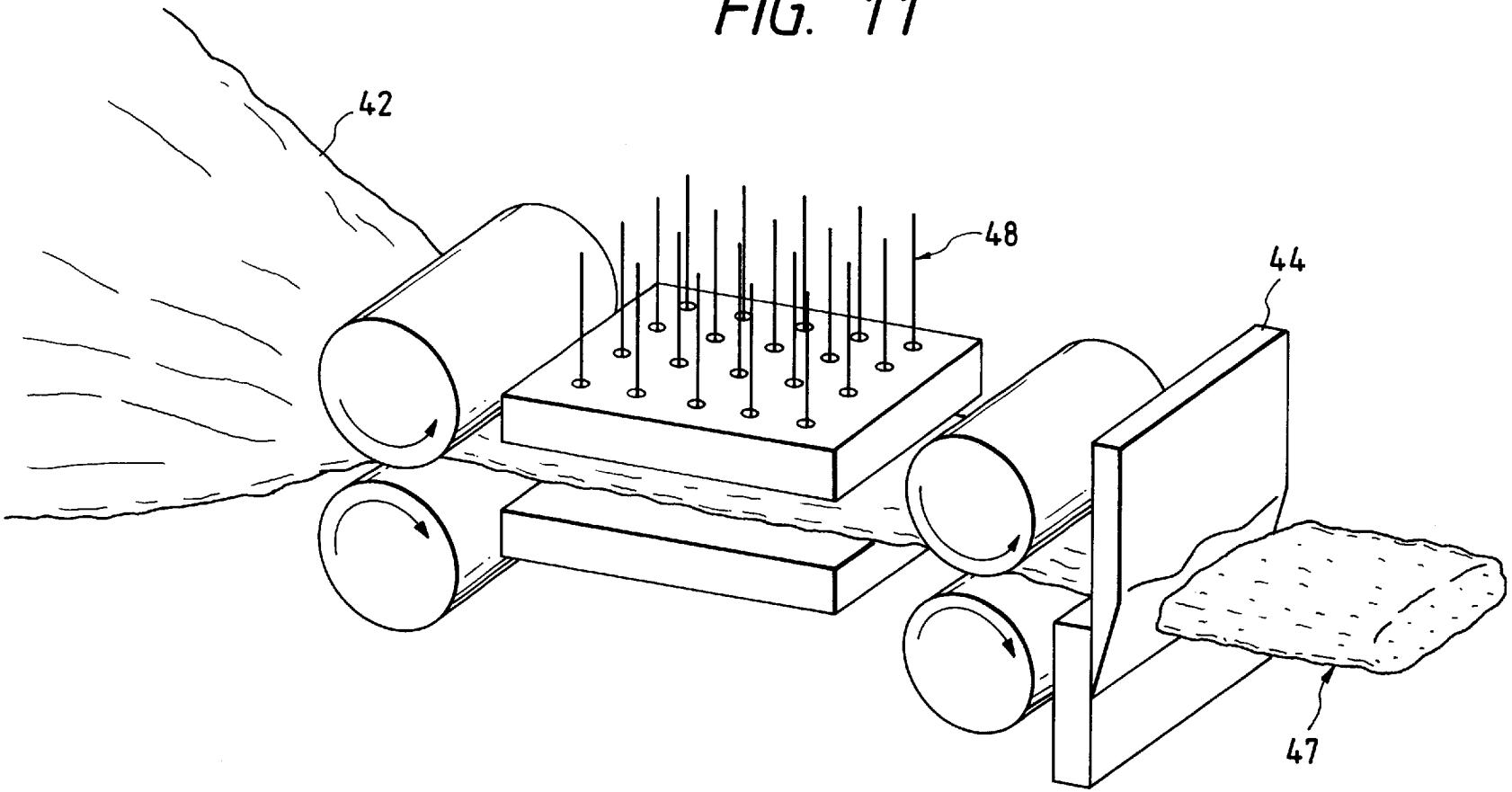
FIG. 11 is a schematic drawing to show a production apparatus for producing fiber bodies of the present invention.

A modification of the fiber body may be such that in the first molding step rollers and needles 48 are used instead of the heating rollers 43 to entangle fibers so as to facilitate conveyance thereof, as shown in FIG. 11. The cross section of the continuous fiber aggregate is of a round rod in use of heat, while the cross section of the continuous fiber aggregate is of a depressed plate in use of needles. Thus, the shape of the fiber body 47 is different from the shape of the fiber body 45 explained in the first embodiment. Accordingly, the fiber bodies can be selectively used with necessity depending upon the configuration of the mold of the ink absorber, or the like.

<Fibers Used>

The above embodiments used the mixture of polypropylene fibers and polyethylene fibers at the weight ratio of 7:3, but without having to be limited to this, fibers applicable may be any combination of mixture fibers and can be adjusted at an arbitrary ratio of mixture.

However, considering the aspect of liquid-contact property (storage stability) to the ink for ink jet print, polyolefin-based materials are preferred.

From the recycling aspect, the ink absorber and the ink tank housing had better be made of materials of the same quality, and in the case of a product-identifying label being provided, the label had better be made also of a material of the same quality.

Figure 12A:
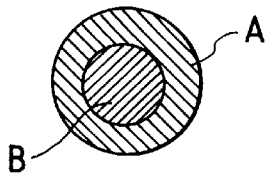
FIGS. 12A and 12B are sectional views to show other structures of fiber according to the present invention.
Figure 12B:
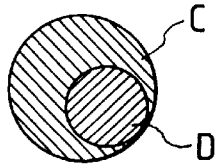

There is no specific restriction on a method of mixture of fibers. If the stock used is a type of a fiber in which two different materials are integrally incorporated as shown in FIG. 12A or FIG. 12B, the step of mixing two types of fibers can be omitted. Use of the fiber shown in FIG. 12B is more desirable if flexibility is required.

<Second Molding Step>

Figure 13A:
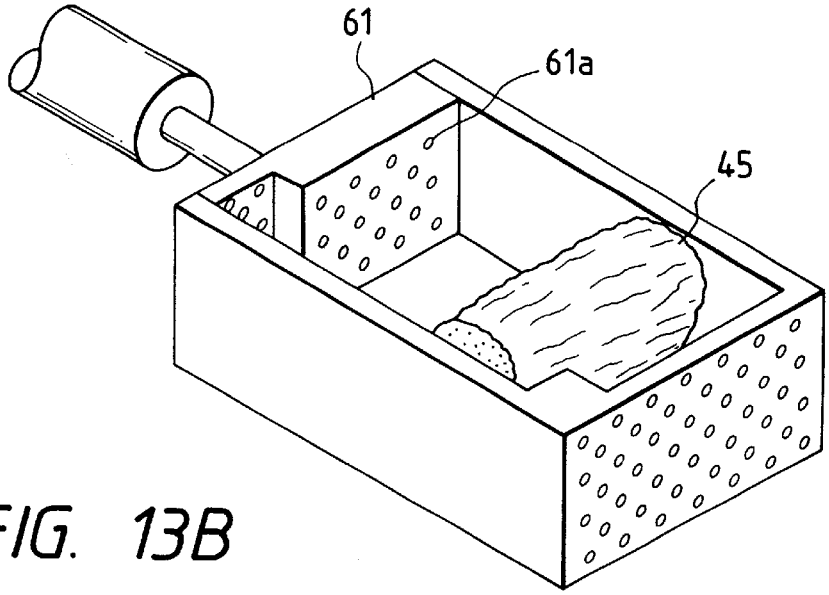
FIGS. 13A and 13B are schematic explanatory drawings to show another process for molding an ink absorber according to the present invention.
Figure 13B:
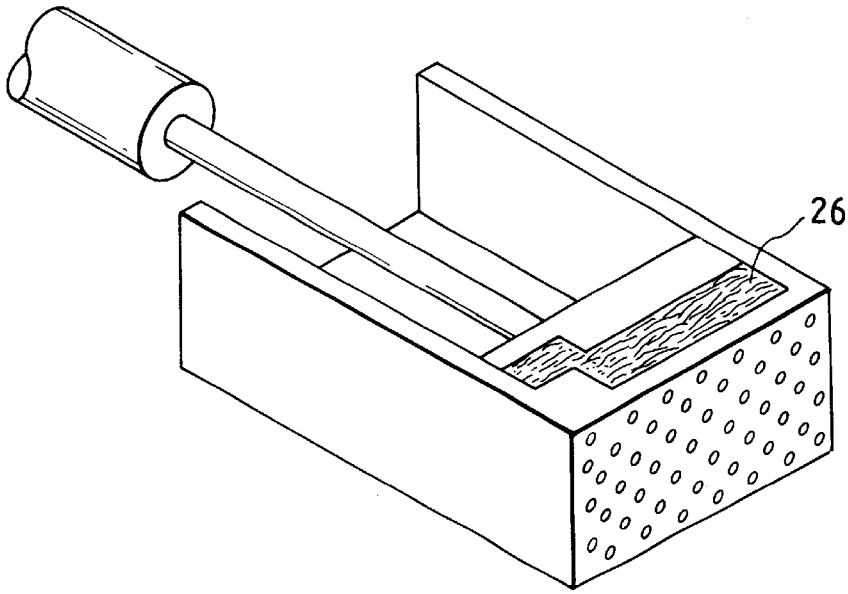

The second molding step in the production process of the ink tank of the present invention was explained with the method for applying the heat to the fiber body and thereafter compressing it, and the method for compressing the fiber body and then applying the heat thereto, but the fiber body may be compressed at the same time as application of heat, using the apparatus shown in FIGS. 13A and 13B.

FIGS. 13A and 13B are drawings to schematically show another method of thermally molding the ink absorber, showing an example for producing the ink absorber 25 of FIG. 1. While hot air generated by a hot air generator not shown is first sent to blow the fiber body 45 through holes 61*a* in a compression plate 61 to which the hot air is acting, as shown in FIG. 13A, the fibers are compressed by the compression plate 61, as shown in FIG. 13B. This method is effective to the cases where the fibers do not have to be solidified up to the inside, and can decrease the molding time.

Figure 15:
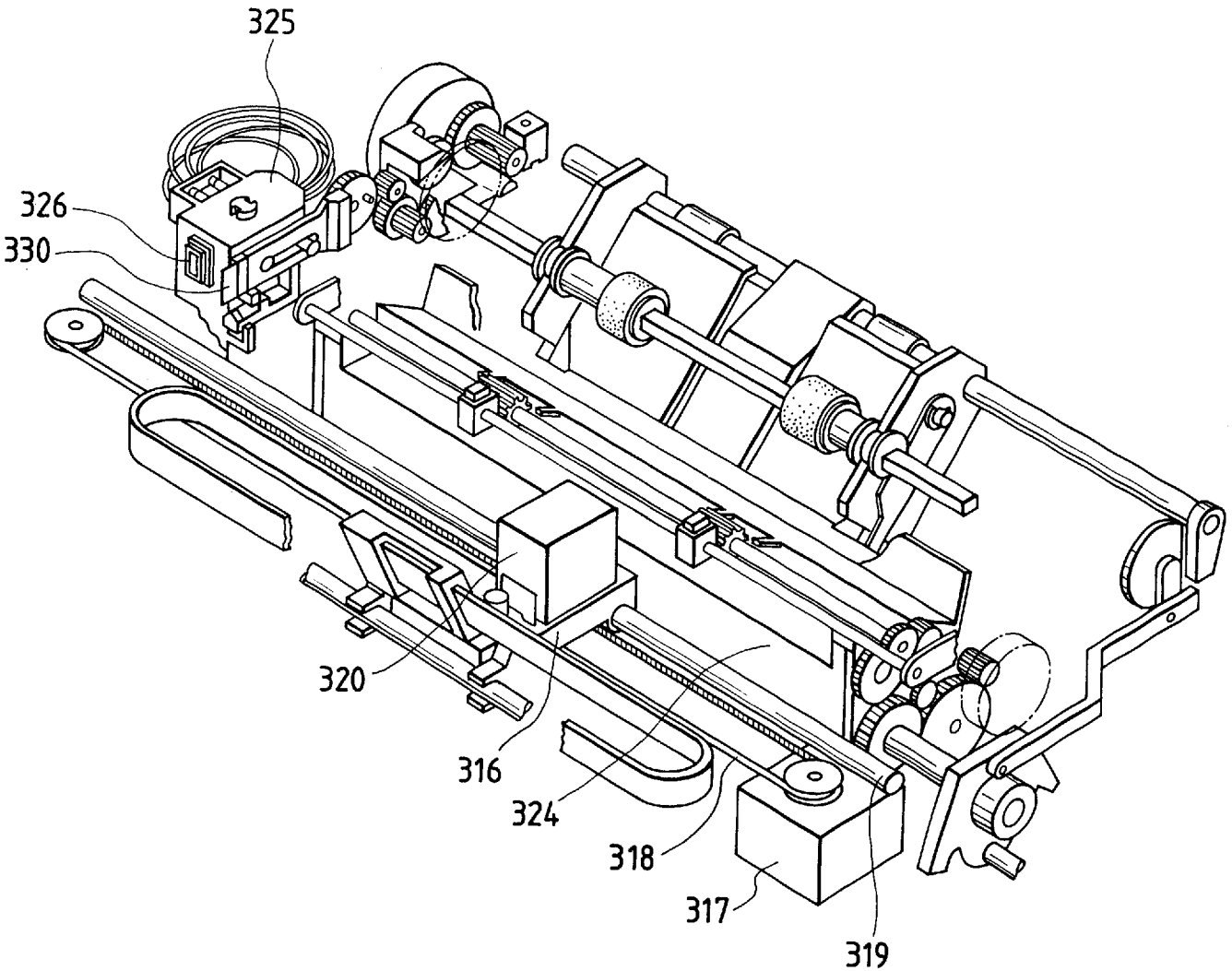
FIG. 15 is a perspective view of an ink jet recording apparatus capable of mounting the ink jet cartridge according to the embodiments of the present invention.

FIG. 15 is a perspective view of an ink jet recording apparatus capable of mounting the ink jet cartridge according to the embodiments of the present invention. An ink jet recording apparatus 300 comprises an ink jet cartridge 320 integrally having a head, mounted on a carriage 316 movable along a shaft 319 by a belt 318 driven a motor 317. The ink jet cartridge 320 is scanned by the carriage 316 and records on a recording medium (not shown) to be conveyed on a platen 324. A reference numeral 325 denotes a suction pump constituting a recovery device, 326 denotes a cap 326 covering the head and 330 denotes a blade member for wiping the discharge port surface of the head to remove foreign substances around the discharge port surface.

What is claimed is:

1. An ink absorber inserted in a housing of an ink tank and being capable of retaining ink, said ink absorber comprising:

at least two fiber bodies, each said fiber body being comprised of an aggregate of plural short fibers, said at least two fiber bodies being heated and compressed in contact with each other, wherein said ink absorber has a thermally molded outer surface the whole of which is thermally molded to equal or correspond substantially to a whole shape of an internal surface of the housing before said ink absorber is inserted into said housing;

wherein the shape of the internal surface of said housing has at least one bending portion and wherein said ink absorber has a bending portion corresponding to the bending portion of said housing.

2. An ink absorber according to claim 1, wherein said fiber bodies are heated from outside so as to thermally mold the outer shape thereof.

3. An ink absorber according to claim 1, wherein said fiber bodies have different sizes.

4. An ink absorber according to claim 1, wherein said plural short fibers are comprised of a polyolefin-based material.

5. An ink absorber according to claim 1, wherein said fiber bodies are comprised of at least two types of fiber materials each having a melting point respectively different.

6. An ink absorber according to claim 1, wherein said short fibers are crossed with each other and wherein the crossings of short fibers are fixed by thermally molding at the crossing.

7. An ink tank capable of retaining ink to be supplied to a recording head, said ink tank comprising:

a housing having an air-communicating portion and an ink supply portion; and an ink absorber housed inside said housing and in contact with a member for introducing ink out of said ink tank, said ink absorber comprising at least two fiber bodies each said fiber body being comprised of an aggregate of plural short fibers, said at least two fiber bodies being heated and compressed in contact with each other, wherein said ink absorber has a thermally molded outer surface the whole of which is thermally molded to equal or correspond substantially to a whole shape of an internal surface of the housing before said ink absorber is inserted into said housing;

wherein the shape of the internal surface of said housing has at least one bending portion and wherein said ink absorber has a bending portion corresponding to the bending portion of said housing.

8. An ink tank according to claim 7, wherein said fiber bodies are heated from outside so as to thermally mold the outer shape thereof.

9. The ink tank according to claim 7, wherein said ink absorber has a plurality of protrusions on at least one surface thereof and said air-communicating portion is in communication with a space formed between the ink absorber and the inner surface of the housing by said plurality of protrusions.

10. An ink tank according to claim 7, wherein said ink absorber is comprised of a polyolefin-based material.

11. An ink jet cartridge comprising:

an ink tank having a housing, the ink tank capable of retaining ink;

a recording head for ejecting ink supplied from said ink tank; and an ink absorber inserted inside said housing and in contact with a member for introducing ink out of said ink tank, said ink absorber comprising at least two fiber bodies, each said fiber body being comprised of an aggregate of plural short fibers, said at least two fiber bodies being heated and compressed in contact with each other, wherein said ink absorber has a thermally molded outer surface the whole of which is thermally molded to equal or correspond substantially to a whole shape of an internal surface of the housing before said ink absorber is inserted into said housing;

wherein the shape of the internal surface of said housing has at least one bending portion and wherein said ink absorber has a bending portion corresponding to the bending portion of said housing.

12. An ink jet cartridge according to claim 11, wherein said fiber bodies are heated from outside so as to thermally mold the outer shape thereof.

13. An ink jet recording apparatus comprising:

an ink tank having a housing, the ink tank capable of retaining ink;

a recording head for ejecting the ink supplied from said ink tank;

an ink absorber inserted inside said housing and in contact with a member for introducing ink out of said ink tank; and a mounting section for mounting said ink tank and said recording head for ink jet recording;

wherein said ink absorber comprises at least two fiber bodies, each said fiber body being comprised of an aggregate of plural short fibers, said at least two fiber bodies being heated and compressed in contact with each other, wherein said ink absorber has a thermally molded outer surface the whole of which is thermally molded to equal or correspond substantially to a whole shape of an internal surface of the housing before said ink absorber is inserted into said housing;

wherein the shape of the internal surface of said housing has at least one bending portion; and wherein said ink absorber has a bending portion corresponding to the bending portion of said housing.

14. An ink jet recording apparatus according to claim 13, wherein said fiber bodies are heated from outside so as to thermally mold the outer shape thereof.

* * * * *

UNITED STATES PATENT AND TRADEMARK OFFICE

CERTIFICATE OF CORRECTION

PATENT NO. : 6,334,674 B1
DATED : January 1, 2002
INVENTOR(S) : Takayuki Ono et al.

It is certified that error appears in the above-identified patent and that said Letters Patent is hereby corrected as shown below:

Title page,
Item [56], References Cited, U.S. PATENT DOCUMENTS,
"4,969,998 A 11/1990 Allen" should read -- 4,968,998 A 11/1990 Allen --;

Item [56], References Cited, FOREIGN PATENT DOCUMENTS,
"JP 0 562 733 9/1993" should read -- EP 0 562 733 9/1993 --;

Column 3,
Line 51, "a" should read -- an --.

Column 6,
Line 27, "the all" should read -- all the --;
Line 58, "a" should read -- the --; and
Line 62, "a" should read -- the --.

Column 7,
Line 14, "were" should read -- was --.

Signed and Sealed this

Twenty-seventh Day of August, 2002

*Attest:*

*Attesting Officer*

JAMES E. ROGAN
*Director of the United States Patent and Trademark Office*